US007407120B1

(12) United States Patent
French

(10) Patent No.: US 7,407,120 B1
(45) Date of Patent: Aug. 5, 2008

(54) ADJUSTABLE RACING INJECTOR

(76) Inventor: Jack French, 218 Bruton Ave., Newport News, VA (US) 23601

( * ) Notice: Subject to any disclaimer, the term of this patent is extended or adjusted under 35 U.S.C. 154(b) by 582 days.

(21) Appl. No.: 10/719,362

(22) Filed: Nov. 21, 2003

Related U.S. Application Data

(60) Provisional application No. 60/428,790, filed on Nov. 21, 2002.

(51) Int. Cl.
*B05B 1/30* (2006.01)

(52) U.S. Cl. ..... 239/585.5; 239/600

(58) Field of Classification Search ..... 123/472, 123/458; 239/585.1–585.5, 600, 533.12
See application file for complete search history.

(56) References Cited

U.S. PATENT DOCUMENTS

| | | | | | |
|---|---|---|---|---|---|
| 723,956 | A | | 3/1903 | Weiss | |
| 1,396,978 | A | | 11/1921 | Tacchella | |
| 1,664,616 | A | * | 4/1928 | French | 239/585.5 |
| 1,970,801 | A | | 8/1934 | Hurst | |
| 2,088,007 | A | | 7/1937 | Zumbusch | |
| 3,004,720 | A | * | 10/1961 | Steinke et al. | 239/585.5 |
| 3,241,768 | A | | 3/1966 | Croft | |
| 3,669,361 | A | * | 6/1972 | Gueret | 239/585.5 |
| 3,913,537 | A | * | 10/1975 | Ziesche et al. | 123/484 |
| 4,590,911 | A | | 5/1986 | Sciotti et al. | |
| 4,993,643 | A | | 2/1991 | Schechter et al. | |
| 5,294,057 | A | * | 3/1994 | Hamilton | 239/417.3 |
| 5,312,050 | A | | 5/1994 | Schumann et al. | |
| 5,626,292 | A | * | 5/1997 | Armaroli et al. | 239/408 |
| 6,012,433 | A | | 1/2000 | Buescher | |
| 6,112,720 | A | * | 9/2000 | Matta | 123/446 |
| 6,131,829 | A | | 10/2000 | Ricco | |
| 6,152,387 | A | | 11/2000 | Ricco | |
| 6,168,094 | B1 | * | 1/2001 | Schatz et al. | 239/533.12 |
| 6,206,304 | B1 | | 3/2001 | Koseki et al. | |
| 6,244,525 | B1 | * | 6/2001 | Gallup et al. | 239/533.12 |
| 6,279,843 | B1 | * | 8/2001 | Coldren et al. | 239/585.1 |
| 6,345,601 | B1 | | 2/2002 | Miyajima et al. | |
| 6,409,094 | B2 | | 6/2002 | Tojo et al. | |
| 6,481,646 | B1 | * | 11/2002 | Hornby | 239/585.1 |
| 6,502,767 | B2 | * | 1/2003 | Kay et al. | 239/433 |
| 6,671,611 | B1 | * | 12/2003 | Peltier | 701/104 |
| 6,679,435 | B1 | * | 1/2004 | Noller et al. | 239/5 |
| 6,769,176 | B2 | * | 8/2004 | Hornby | 29/890.09 |
| 7,136,743 | B2 | * | 11/2006 | Peltier | 701/115 |
| 7,266,515 | B2 | * | 9/2007 | Costello et al. | 705/27 |
| 2001/0022320 | A1 | | 9/2001 | Tojo et al. | |
| 2002/0117557 | A1 | | 8/2002 | Potschin et al. | |
| 2003/0019955 | A1 | | 1/2003 | Schraudner et al. | |
| 2004/0158384 | A1 | * | 8/2004 | Kuegel et al. | 701/104 |

* cited by examiner

*Primary Examiner*—Carl S Miller
(74) *Attorney, Agent, or Firm*—Albert W. Watkins

(57) ABSTRACT

An adjustable racing injector injects fuel by carrying out an opening and closing of a fuel orifice in a valve seat. The fuel orifice is controlled by a signal, typically provided by an engine control unit, which energizes a magnetic circuit including coil which in turn will effect movement of a needle. The adjustable racing injector is field reconfigurable and may be provided as discrete components, or may be provided as an assembly together with a collection of replaceable components that are designed to controllably alter the performance of an engine to which the injector is attached. All of the performance components may be readily replaced in the field, while still obtaining repeatable performance across a plurality of injectors.

1 Claim, 4 Drawing Sheets

ADJUSTABLE RACING INJECTOR

CROSS REFERENCE TO RELATED APPLICATIONS

This application claims priority to U.S. provisional application Ser. No. 60/428,790 filed Nov. 21, 2002 by Jack M. French, III entitled "Adjustable Racing Injector", the contents which are incorporated herein in entirety.

BACKGROUND OF THE INVENTION

1. Field of the Invention

This invention pertains broadly to fluid sprinkling, spraying, and diffusing, and more specifically to fuel injectors. The present invention comprises a fuel injector having a rigid fluid confining distributor with an assembly and disassembly feature.

2. Description of the Related Art

A fuel injector is an electro-mechanical device that is used to precisely meter specific amounts of fuel, and preferably controllably spray the metered fuel to form a combustible mixture within internal combustion engines. Because an internal combustion cylinder occupies a relatively small volume, the amount of fuel which will desirably be admitted on a single intake stroke is very small. However, the characteristics of combustion change rather dramatically with even seemingly minor changes in the amounts of fuel introduced into the combustion chamber. Nowhere is this more evident than in the field of racing, where very tiny differences in performance may result in substantially different race outcomes. Consequently, the careful tuning of each component within the very complex power and drive trains is practiced on nearly all racing machines. Of particular interest, as aforementioned, is the tuning of a fuel injector.

The art of tuning an engine through fuel injector changes has been practiced heretofore by the substitution of one fuel injector for another. These injectors have been manufactured in a factory as a single component assembled from many discrete piece parts. At the time of manufacture, it is not uncommon for parts being produced identically upon the same assembly line to have substantial variations in the amount of fuel delivered. Many manufacturers have heretofore resorted to hand grinding or machining components to individually adjust them to bring the fuel injection characteristics within specification. Such assembly techniques are difficult and expensive. Nevertheless, this type of work has heretofore been a necessity, and could only reasonably be done by the manufacturer. Consequently, if a racer, technician, mechanic, engineer, or anyone else determines that a slight increase in the amount of fuel delivered to one or more combustion cylinders is required, then a different set of fuel injectors would need to be purchased and installed. This practice necessitates the purchase and maintenance of substantial inventories of injectors, since, to accommodate a range of needs, a large number of injectors, each having distinct characteristics, may be required. Since many modern engines will have at least one injector per combustion cylinder, the number of injectors required will be equal to the number of cylinders multiplied by the number of injectors required to adequately cover the possible range of values needed. As may quickly be recognized, this can lead to a very large collection of injectors.

A further drawback with prior art injectors arises from the inherent fixed nature of a stock component. There is absolutely no opportunity for any further tuning, even minor fine tuning, and yet, as aforementioned, even tiny boosts in performance may substantially alter the outcome of a race. Furthermore, the careful balancing of cylinders may permit higher engine speeds and smoother operation.

There have been fuel injectors heretofore proposed which may be disassembled and re-worked for repair. Exemplary is U.S. Pat. No. 1,396,978 to Tachella, the teachings which are incorporated herein by reference, which illustrates a fuel injector designed for maintenance and modification with minimal down-time. Additional documents which provide further teachings of various injector constructions are also incorporated herein by reference for their teachings, including U.S. Pat. Nos. 723,956 to Weiss; 1,970,801 to Hurst; 2,088,007 to Zumbusch; 3,241,768 to Croft; 4,590,911 to Sciotti et al; 4,993,643 to Schechter et al; 5,312,050 to Schumann et al; 6,012,433 to Buescher; 6,131,829 and 6,152,387 to Ricco; 6,206,304 to Koseki et al; 6,345,601 to Miyajima et al; 6,409,094 and 2001/0022320 to Tojo et al; and U.S. published applications 2002/0117557 to Potschin et al; and 2003/0019955 to Schraudner et al.

As these prior art documents illustrate, fuel injectors must be specifically designed, built and calibrated for each engine application. If a person wishes to change engine or injector performance, or otherwise alter or upgrade an engine, it will normally be necessary to replace the fuel injectors with a new set of injectors that are specifically designed for optimal performance in the new configuration. This is both time consuming and expensive. What is desired then is a way to customize the injector for the specific characteristics of an engine design, without requiring the stocking of an enormous variety and quantity of injectors.

SUMMARY OF THE INVENTION

In a first manifestation, the invention is fuel injector having field replaceable components exchangeable to change at least one characteristic. The fuel injector includes an electrical power connector that is adapted to receive a fuel injector energization signal. An electrical actuating coil is electrically coupled to the electrical power connector and powered by the fuel injector energization signal to controllably produce a magnetic field. A ferromagnetically responsive needle moves responsive to variations in the magnetic field. A valve seat having a fuel passage therethrough is selectively closed or opened by movement of the ferromagnetically responsive needle. A fuel inlet receives fuel into the fuel passage, and a flow disk receives fuel from the fuel passage and disperses it within an internal combustion engine. A housing encloses the electrical actuating coil, ferromagnetically responsive needle, valve seat, and flow disk, and also has a fuel inlet and a fuel outlet. The housing further has a field removable and replaceable closure which provides field access to and replacement of field replaceable components, to thereby change at least one of the fuel injector's characteristics.

In a second manifestation, the invention is a method for adjusting at least one fuel injector for internal combustion engine operation in an internal combustion engine having a plurality of fuel injectors. According to the method, at least one fuel injector comprising field replaceable performance altering components is assembled. A substitute for at least one of the field replaceable performance altering components is provided in a performance altering geometry having critical characteristics sufficiently matched to the at least one of the field replaceable performance altering components to enhance internal combustion operation by replacement. Fuel injector fuel dispensing characteristics are modified by replacing at least one of the field replaceable performance altering components with a substitute.

OBJECTS OF THE INVENTION

Exemplary embodiments of the present invention solve inadequacies of the prior art by providing injector housings and components that are field replaceable. Fine tuning through grinding and the like which are common in the prior art are avoided, and the preferred injectors are readily disassembled and re-assembled with the new components. Both electrical and mechanical components are replaceable in the preferred embodiments.

A first object of the invention is to ruggedly enclose an injector for operation in the harsh environment surrounding and within an internal combustion engine. A second object of the invention is to provide repeated access through the enclosure to replace any of the many performance components found within an injector. Another object of the present invention is to provide ways for electrical, magnetic and mechanical adjustment or alteration. A further object of the invention is to permit replacement and adjustment of a plurality of injectors on a single engine in the field, without necessitating factory calibration of the injectors. Yet another object of the present invention is to provide a collection of injector performance components that may be used to adapt an injector to many diverse applications, thereby avoiding the substantial inventory of injectors that were required in the prior art.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
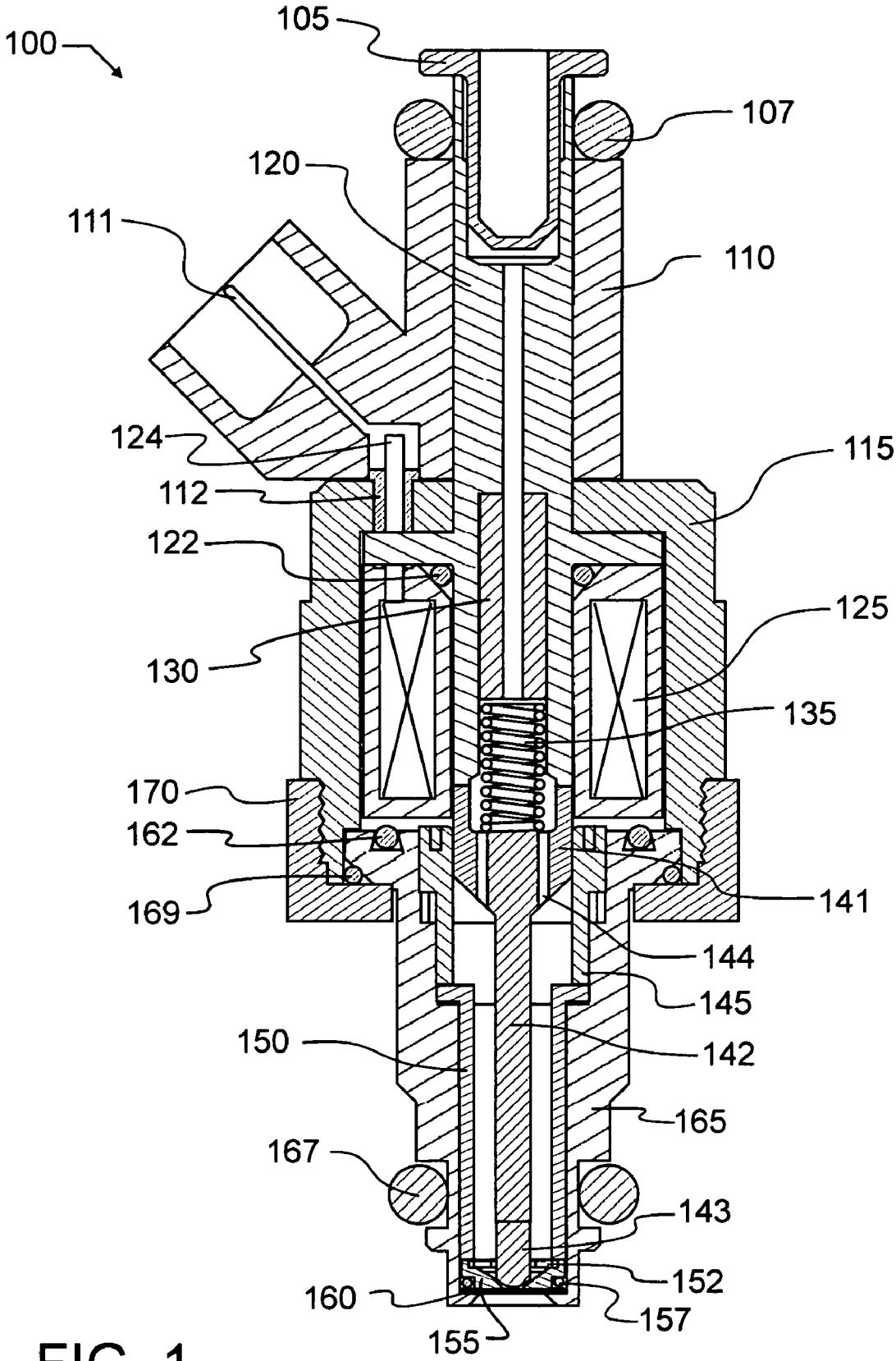
FIG. 1 illustrates a preferred embodiment of the invention from front cross-sectional view.
Figure 2:
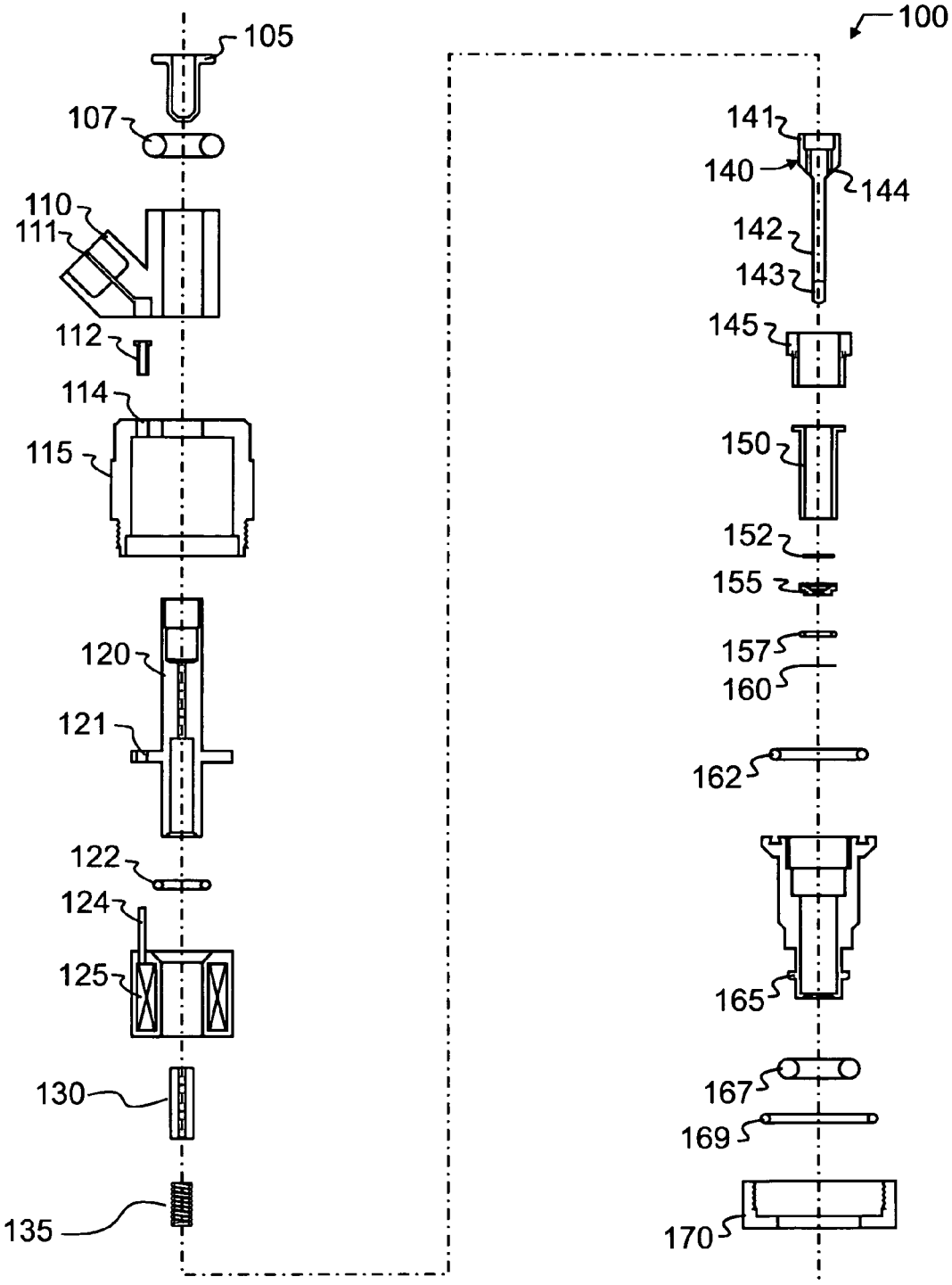
FIG. 2 illustrates the preferred embodiment of FIG. 1 by exploded cross-sectional view, with cross-hatching removed for ease of illustration.

In a most preferred embodiment of the invention illustrated in FIGS. 1 and 2, the teachings of the present invention are applied to a provide an adjustable racing injector (ARI) 100 that may be disassembled, and then reassembled using different working components. Fuel is received into the upper end of adjustable racing injector 100 through a filter 105, which is provided to prevent the entrance of any dust and foreign matter into the fuel passage which extends from the top longitudinal center of fuel tube 120 to flow disk 160 adjacent the lower end of adjustable racing injector 100. At the longitudinal center of fuel tube 120 distal to filter 105, an enlarged passage is provided. This passage holds a spring calibration tube 130. Spring calibration tube 130 is in contact with spring 135 at the lower end, and is used to adjust a set load therewith. Spring 135 presses at one end against spring calibration tube 130, and at the other end against one end of needle 140. This in turn presses needle 140 against valve seat 155. The needle 140 is comprised of ferromagnetic member 141, a rod 142 and a tip 143.

Coil 125, which may selectively be energized to produce a magnetic field and thereby interact with ferromagnetic member 141 as discussed herein below, may be wound around a bobbin and the outer periphery molded using a plastic material, as is known in the art. A terminal 124 of coil 125 is inserted into a hole 121 which is provided on an annular projecting portion of fuel tube 120. This terminal 124 passes through insulator 112 and is connected through electrical connector terminals 111 with an electrical connector that is in turn connected electrically to an engine control unit. Connector terminals 111 are held within connector body 110.

Adjacent ferromagnetic member 141 are provided one or more passages 144 for permitting fuel to pass through. Seat lock 145 abuts with seat location tube 140, and together form a passage through which needle 140 may pass and within which fuel will also be confined. The outer periphery of the ferromagnetic member 141 is in contact with coil 125 and seat lock 145, and is movable in an axial direction thereof guided by the inner wall of each. Seat location tube 150 engages with valve seat 155, and retains valve seat 155, o-ring 157, and flow disk 160 in position adjacent valve carrier 165. Valve seat 155 has a central opening, but is configured to be closed by tip 143, and thus block the passage of fuel, when coil 125 is not energized. Seat lock 145 in the preferred embodiment is rigidly attached to valve carrier 165 via a threaded connection. In this embodiment, a special tool insert may be provided to permit seat lock 145 to be rotated, though seat lock 145 may be attached to valve carrier 165 using other techniques as well.

Flow disk 160, which also has an opening passing there through, serves to produce the desired spray pattern best suited for a particular combustion chamber or engine design. Furthermore, the geometry of one or more openings through flow disk 160 may be controlled or adjusted to fine tune performance. While the use of selected nozzle geometries is heretofore known and will be understood by those skilled in the art, the use of a disk such as illustrated in the preferred embodiment, which may be flat as illustrated or which may have additional dimension, offers much advantage. One benefit of this disk geometry is the ability to form such disk from sheets using very precise techniques such as laser or chemical milling or the like. These techniques are capable of the utmost precision for only nominal per-part cost. Many prior art nozzles have been milled using electric discharge machining techniques or the like, which are far more costly and which must be completed one part at a time, consequently increasing risk of deviation between parts.

The stroke of needle 140, which is the amount of movement in a longitudinal direction, is set to a dimension determined by the size of an air gap which will be present between ferromagnetic member 141 and fuel tube 120, when coil 125 is not energized. In this state, tip 143 will be pressed against valve seat 155, and needle 140 will be at one extreme of travel. When coil 125 is fully energized, needle 140 will move along a longitudinal axis until ferromagnetic member 141 is adjacent to fuel tube 120. While the movement is real and measurable, the typical amount of travel is very small, measured typically as approximately 150 microns. However, and as already understood from the foregoing, the amount of travel may readily be adjusted to a desired value using the features and teachings of the present invention.

The operation of adjustable racing injector 100 involves activation by an electric signal supplied to electromagnetic coil 125. Responsive to a magnetic field produced within coil 125, needle 140 is moved adjacent fuel tube 120, opening the gap between tip 143 and valve seat 155. Accordingly, the injection of fuel from injector 100 is carried out. When the electric signal is discontinued, the magnetic field produced by coil 125 collapses, and spring 135 forces needle 140 away from fuel tube 120 until tip 143 engages with valve seat 155. This prevents further passage of fuel, and thereby stops any further injection.

The fuel that is supplied under pressure to the interior portion of adjustable racing injector 100 passes through filter 105 into the interior of the fuel tube 120. After passing through holes 144 in ferromagnetic member 141, the fuel is then retained within the confines of seat lock 145 and seat location tube 150. During energization of coil 125, which actuates needle 140, the fuel will pass through the opening in valve set 155, and will then pass through flow disk 160 and be expelled in a pattern determined by flow disk 160.

Access to components internal to adjustable racing injector 100 is provided through valve seat carrier jam nut 170, which is removable from coil can 115. In the embodiment of FIGS. 1 and 2 illustrated, this valve seat carrier jam nut 170 will be threaded onto coil can 115, and is removable therefrom by rotation relative to the coil can, such as may be accomplished with wrenches or appropriate sockets or the like. O-ring 169 is provided to ensure adequate seal. However, the present invention is not limited to the use of threading, and other means of enclosing the injector which provide non-destructive access into the interior may be provided. Such methods may include the use of other types of fasteners and couplings, and may even include destructible fasteners such as adhesive connections, provided the destructible fastener may be destroyed and then replaced without adversely affecting performance of the injector.

Figure 3:
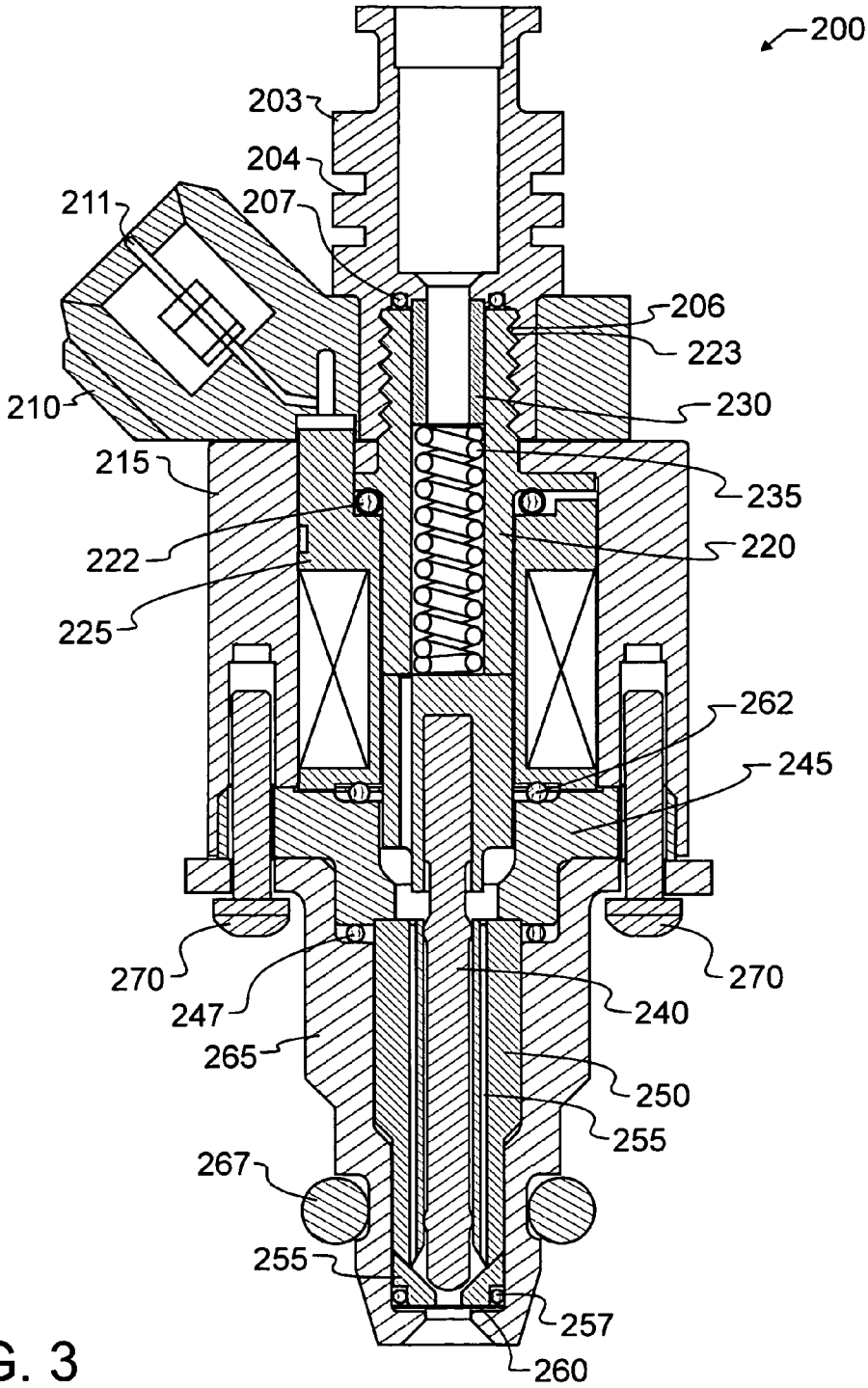
FIG. 3 illustrates a second preferred embodiment of the invention from front cross-sectional view.
Figure 4:
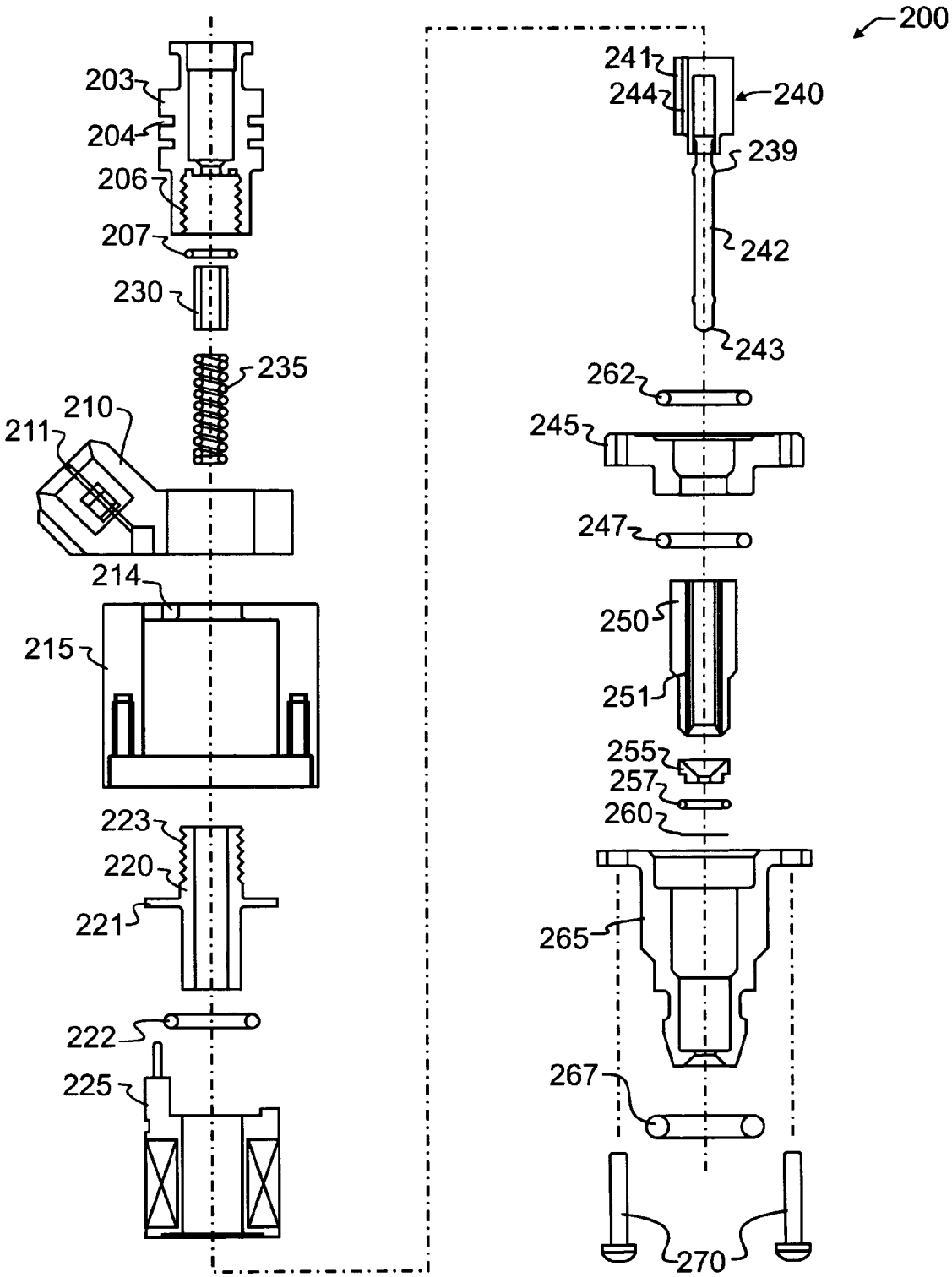
FIG. 4 illustrates the second preferred embodiment of FIG. 3 by exploded cross-sectional view, with cross-hatching removed for ease of illustration.

A second preferred embodiment adjustable racing injector 200 is illustrated in FIGS. 3 and 4. While the first digit of each component is the number 2, which designates this second embodiment, the second and third digits have been selected to match the second and third digits of the first embodiment for like parts or parts of like function. Consequently, those skilled in the art will readily determine the function and operation of many of the components therein without unnecessary additional description. In this second embodiment, a specially machined fuel connector 203 includes grooves 204 which are designed for clips to hold adjustable racing injector 200 to the fuel rail. While not illustrated, it will be understood that a filter similar to filter 105 will in most instances also be included, as would an o-ring similar to o-ring 107. At the end of fuel connector 203 distal to the filter inlet, female threading 206 is provided on the inside diameter thereof, the purpose for which will be apparent herein below.

Received within fuel connector 203 is an o-ring 207, spring calibration tube 230, and spring 235, which have operation similar to the counterparts of the first embodiment. Fuel tube 220 is simplified, having a single diameter bore but including male threads 223 formed on the outer diameter. These threads 223 mate with threads 206. In this embodiment, connector 203 is shaped on an exterior to have six major sides, similar to a hex nut. Consequently, connector 203 may be threaded down onto fuel tube 220. During this threading process, electrical connector body 210 will gradually be locked into position together with coil can 215. One significant feature of the present invention, including both of the preferred embodiments, is the ability to readily replace not only the fuel components, but also the electrical components. As should be apparent now, electrical connector body 210 may be manufactured to take on one of many different forms required by different manufacturers. Consequently, adjustable racing injector 200 of this preferred embodiment may be designed for use with many different vehicles, with appropriate substitution of components. Where the only change required is the replacement of the electrical connector body 210, this may be achieved by unthreading fuel connector 203 from fuel tube 220 and then replacing electrical connector body 210. If the only changes required are electrical, then these changes may readily be accommodated by changing coil 225 and electrical connector 210. Since each of the components may be changed readily, other various adjustments including changes such as changes in materials and magnetic permeability and the like may also be made to any of the components.

Needle 240, while similar to needle 140, has a particularly significant difference therein. Rod 242 is provided with several larger diameter protrusions 239 which serve to guide needle 240 within needle sleeve 250. These protrusions 239 ensure proper placement and alignment. Needle sleeve 250 will incorporate fuel passages therein which permit fuel to travel longitudinally through needle sleeve 250 directly to valve seat 255. Valve carrier 265 receives flow disk 260, o-ring 257, valve seat 255, needle sleeve 250, o-ring 247, and seat lock 245 therein. Needle 240 passes through the central opening in seat lock 245, and contacts with valve seat 255 at needle tip 243. The entire assembly between coil can 215 and valve carrier 265 is held together with a set of bolts or the like which pass from the valve carrier exterior into coil can 215. Locking compounds may preferably be used to ensure that the bolts stay put even when vibrated during engine operation. Finally, an o-ring 267 may preferably be provided adjacent the fuel outlet of valve carrier 265.

Adjustable racing injectors 100 and 200 will most preferably be reassembled using either the existing components from within the injector, or with various alternative components that are made available in a tuning kit comprising an assortment of internal parts. The changing of individual components within the injector enables a racer, crew, shop, engine builder or anyone interested in changing the performance of an engine to also change any of the functional characteristics of the injector. It also enables a person to upgrade engine performance without having to purchase a new set of injectors. These parts may be changed in the field, and yet the components do not, by virtue of their present design, require additionally machining or special tools to bring the components within specification or desired performance. A plurality of injectors may be adjusted at once, without fear of substantial differences being created between individual injectors.

Performance characteristics that may be altered include, but are not limited to fuel flow; fuel spray pattern and atomization; injector flow calibration point; coil resistance; and coil impedance.

Fuel flow may be adjusted by changing any one of the following injector parameters individually, by changing other known parameters, or by changing any combination of one or more parameters:

- valve opening, which represents the distance the needle raises out of the valve seat;
- total area of hole(s) in flow disk;
- spring force used to close needle against valve seat when coil is not energized;
- calibration height of spring (compressed height of spring may be varied for calibration purposes);
- magnetic force exerted by coil while it is energized;
- time to raise needle completely out of valve seat once coil is energized; and/or
- time to lower needle back into valve seat once coil is de-energized.

Fuel spray pattern and atomization may be adjusted by changing any one of the following injector parameters individually, by changing other known parameters, or by changing any combination of one or more parameters:

total area of hole(s) in flow disk;
number of hole(s) in flow disk;
pattern of holes in flow disk;
angle of the hole(s) in the flow disk;
bolt circle diameter of the hole(s) in the flow disk;
dimple geometry of flow disk; and/or
thickness of the flow disk.

Injector flow calibration point may be adjusted by changing any one of the following injector parameters individually, by changing other known parameters, or by changing any combination of one or more parameters:

system fuel pressure;
injector valve opening;
spring force;
calibration height of the spring;
magnetic force exerted by the coil;
time to raise the needle completely out of the valve seat once the coil is energized; and/or
time to lower the needle back into the valve seat once the coil is de-energized.

Injector coil resistance may be adjusted by changing any one of the following injector parameters individually, by changing other known parameters, or by changing any combination of one or more parameters:

number of wire turns in the coil;
gage of wire used in coil; and/or
material of wire used in the coil.

Injector coil impedance may be adjusted by changing any one of the following injector parameters individually, by changing other known parameters, or by changing any combination of one or more parameters:

number of wire turns in the coil;
adjacent magnetically permeable material;
gage of wire used in coil; and/or
material of wire used in the coil.

Fuel injector valve opening may be adjusted by changing any one of the following injector parameters individually, by changing other known parameters, or by changing any combination of one or more parameters:

overall length of the needle;
overall length/height of the valve seat;
distance from the bottom of the seat to the sealing surface of the seat cone;
overall length of the fuel tube;
distance from the bottom of the fuel tube to top edge of the housing flange of the fuel tube;
depth of the seat pocket in the valve seat carrier; and/or
thickness of the flow disk.

The adjustable racing injector embodiments illustrated herein above and the various internal components used therein may be manufactured from a variety of materials, including but not limited to metals, resins and plastics, glasses, ceramics or cementitious materials, or combinations of the above. The specific material used may vary as is known in the industry, and may specifically be varied to obtain different performance results. As referenced, a component material may be chosen specifically to alter magnetic characteristics or other performance affecting characteristic, without other change being made to the component.

The varying components may be visually identifiable as having a specific characteristic, and such identifiers are contemplated herein. For example, a set of components designed to deliver a particular performance characteristic may be designated either by special colorings, unique markings, or even unique shapes where such shapes do not otherwise interfere with performance. Whether different components are paired by common indicia, or whether the indicia only relates to a single component type will be determined by the designer in accord with the teachings of the present invention.

A variety of designs have been contemplated for the adjustable racing injector and associated components, as described herein above. Other variations are also contemplated with regard to alternative embodiments. Consequently, while the foregoing details what are felt to be the most preferred embodiments of the invention, no material limitations to the scope of the claimed invention are intended. The possible variants that would be possible from a reading of the present disclosure are too many in number for individual listings herein, though they are understood to be included in the present invention. Further, features and design alternatives that would be obvious to one of ordinary skill in the art are considered to be incorporated also.

I claim:

1. A fuel injector having field replaceable components exchangeable to change at least one of said fuel injector's characteristics, said fuel injector comprising:

an electrical power connector adapted to receive a fuel injector energization signal;

an electrical actuating coil electrically coupled to said electrical power connector and powered by said fuel injector energization signal to controllably produce a magnetic field;

a ferromagnetically responsive needle movable responsive to variations in said magnetic field;

a valve seat having a fuel passage therethrough, said fuel passage selectively closed or opened by said movement of said ferromagnetically responsive needle;

a fuel inlet for receiving fuel into said fuel passage;

a flow disk receiving fuel from said fuel passage and dispersing said fuel within an internal combustion engine;

a housing enclosing said electrical actuating coil, said ferromagnetically responsive needle, said valve seat, and said flow disk, said housing having a fuel inlet and a fuel outlet and further having a field removable and replaceable closure which provides field access to and replacement of said field replaceable components and thereby change at least one of said fuel injector's characteristics;

a longitudinally extensive valve seat location tube having a first end and a second end longitudinally distal to said first end, said first end capturing said valve seat adjacent said housing and further having a longitudinally extensive internal needle passage and longitudinal fuel flow passages terminating adjacent said valve seat, said longitudinal fuel flow passages separate from, parallel to and adjacent to said longitudinally extensive internal needle passage; and a valve seat lock mechanically engaging said housing and capturing said longitudinally extensive valve seat location tube therein.

* * * * *